US005122202A

United States Patent [19]

Dykstra et al.

[11] Patent Number: 5,122,202

[45] Date of Patent: Jun. 16, 1992

[54] METHOD AND COMPOSITIONS FOR COATING NON-FERROUS METALS

[75] Inventors: Kenneth A. Dykstra, Napa; Frank A. Muller, West Los Angeles, both of Calif.

[73] Assignee: Elf Atochem North America, Inc., Philadelphia, Pa.

[21] Appl. No.: 548,050

[22] Filed: Jul. 5, 1990

[51] Int. Cl.[5] ..... C23C 22/34

[52] U.S. Cl. ..... 148/247; 148/251

[58] Field of Search ..... 427/251, 247

[56] References Cited

U.S. PATENT DOCUMENTS 3,912,548 10/1975 Faigen ..... 148/6.15 R
4,191,596 3/1980 Dollman et al. ..... 148/6.27
4,921,552 5/1990 Sander ..... 148/247

FOREIGN PATENT DOCUMENTS 2487381 1/1982 France ..... 148/287

*Primary Examiner*—Sam Silverberg

[57] ABSTRACT

Promotion of paint adhesion and corrosion resistance on the surface of a non-ferrous metal such as aluminum by contact with an aqueous acidic solution containing an anionic polyacrylic/polyacrylamide copolymer, ammonium zirconium fluoride, nitric acid, and water.

6 Claims, No Drawings

METHOD AND COMPOSITIONS FOR COATING NON-FERROUS METALS

FIELD OF THE INVENTION

This invention relates to non-chromated compositions and methods for coating the surface of a non-ferrous metal such as aluminum to promote paint adhesion and corrosion resistance. The compositions contain an anionic polyacrylic/polyacrylamide copolymer ("APPC"), $(NH_4)_2ZrF_6$ (ammonium zirconium fluoride or "AZF"), nitric acid, water, and, optionally, a mold inhibitor.

BACKGROUND OF THE INVENTION

As described for example in U.S. Pat. No. 4,191,596, there has been a growing environmental concern over the chromate conversion coatings used to improve the corrosion resistance and paint adhesion properties of non-ferrous metal surfaces. This patent also describes some of the proposed alternative coating solutions based on the use of (a) polyacrylic acid or esters thereof and (b) fluoride compounds such as fluozirconic acid, though it teaches that AZF yields poor coatings (columns 5-6, Comparison D).

Applicants are not aware of any literature disclosing the use of coating solutions based on a combination of APPC and AZF.

SUMMARY OF THE INVENTION

An aqueous acidic solution is provided for coating the surface of a non-ferrous metal (preferably aluminum). The solution contains APPC, AZF, nitric acid, and water. A mold inhibitor such as methyl parahydroxy benzoate may also be present.

The invention also provides a method for coating the metal surface in which the surface is contacted with the aqueous acidic solution to form the desired coating. Preferred methods of application are spraying and dipping. After application of the coating the surface is dried, optionally with heating.

The coatings of the present invention are useful in the production of metal door-sidings, boat-hulls, and the like.

DETAILED DESCRIPTION OF THE INVENTION

It has now been found that coating solutions based on APPC, AZF, nitric acid, and water allow paint adhesion and corrosion resistance to prevail on metal surfaces with both solvent and more environmentally compatible water-based paints. Moreover, such solutions are readily applied by spraying or dipping.

Non-ferrous metals include aluminum, zinc, magnesium, copper, cadmium, nickel, and titanium. Aluminum and zinc are preferred, especially aluminum. Aluminum includes pure aluminum and alloys thereof including extrusions, cast, wrought, and sintered alloys.

Tap or deionized water may be used, preferably deionized.

Nitric acid is used since unacceptable coatings have been formed when using hydrofluoric acid and sulfuric acid.

The APPC normally has a molecular weight of up to about 500,000, preferably about 100,000 to 500,000. Acceptable results have been obtained with an aqueous APPC solution having 25% solids, a pH of 5-6, and a viscosity at 20° C. of 4000-8000 centipoise; the molecular weight is about 250,000. Such solutions are available commercially, for example, as PRAESTAMIN AL, a product of Stockhausen, Inc. Poor paint adhesion was obtained with a cationic form of the copolymer. When AZF, nitric acid, and water are combined with polyacrylic acid and esters thereof (as taught by U.S. Pat. No. 4,191,596), a white precipitate is formed, whereas the present invention provides clear, stable solutions.

Since different solution concentrations may be desired depending on the method of application, the amount of metal to be treated, and the like, it is convenient to prepare concentrates for mixing and dilution as needed. For example, it has been found useful to prepare concentrates of (I) 98 to 40 parts by weight of water and 2 to 60 parts by weight (25% basis) of APPC (PRAESTAMIN AL), preferably 84-68 parts water and 16-32 parts APPC (pH about 4-5.5); and (II) 97.9 to 73 parts water, 2 to 15 parts nitric acid, and 0.1 to 12 parts AZF, preferably 91-83 parts water, 5-9 parts nitric acid, and 4-8 parts AZF (pH about 1.1-2.3). When spraying, a convenient dilution is 1.25 parts of I and 1 part of II (by volume) in 100 parts of water. For dipping the same or a more concentrated solution may be desired, such as 1.875 parts of I and 1.5 parts of II in 100 parts of water. If many metal parts are to be treated at one time, it may be advantageous to double concentration of the dipping solution. If a mold inhibitor such as methyl parahydroxy benzoate (available commercially as METHYL PARASEPT, a product of Kalama Chemical, Inc.) is used, it can be added to concentrate I in minor amounts.

Dipping for about 8-20 minutes is generally sufficient. The coated metal may then be allowed to dry at ambient temperature for 24 hours or oven dried at about 50°-95° C.

EXAMPLES

1. A dipping solution (pH 2.6) was made from (a) 100 parts (by volume) of water; (b) 1 part of a concentrate containing (by weight) 86.6% deionized water, 7.4% nitric acid, and 6% AZF (pH 1.8); and (c) 1.25 parts of a concentrate containing 76% deionized water and 24% Praestamin AL (25%) (pH 4.3).

Cleaned aluminum was dipped for 12 minutes in the coating solution, drip dried for 15 minutes, and oven dried (at 82° C.) for 15 minutes. The dried aluminum was then painted with satisfactory adhesion with an oil-based paint.

2. Example 1 was repeated with the same results except that the concentrate in part (c) contained 75.95% deionized water, 24% Praestamin AL, and 0.05% Methyl Parasept mold inhibitor.

3. Example 1 was repeated with the same results except that the aluminum was sprayed rather than dipped and the paint was water-based.

What is claimed is:

1. An aqueous acidic solution for coating the surface of a non-ferrous metal comprising water, nitric acid, ammonium zirconium fluoride, and an anionic polyacrylic/polyacrylamide copolymer having a molecular weight of from 100,000 to about 500,000.

2. Claim 1 wherein the metal is aluminum.

3. Claim 2 wherein the solution further comprises a mold inhibitor.

4. A process for coating the surface of a non-ferrous metal which comprises contacting said surface with an aqueous acidic solution comprising water, nitric acid, ammonium zirconium fluoride, and an anionic polyacrylic/polyacrylamide copolymer having a molecular weight of from 100,000 to about 500,000.

5. The process of claim 4 wherein the metal is aluminum.

6. The process of claim 5 wherein the solution further comprises a mold inhibitor.

* * * * *